US007413500B2

(12) United States Patent
Moore et al.

(10) Patent No.: US 7,413,500 B2
(45) Date of Patent: Aug. 19, 2008

(54) METHODS FOR PLANARIZING WORKPIECES, E.G., MICROELECTRONIC WORKPIECES

(75) Inventors: Carter Moore, Boise, ID (US); Elon Folkes, Boise, ID (US); Terry Castor, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 11/471,975

(22) Filed: Jun. 21, 2006

(65) Prior Publication Data

US 2007/0010168 A1 Jan. 11, 2007

Related U.S. Application Data

(63) Continuation of application No. 10/796,257, filed on Mar. 9, 2004, now Pat. No. 7,086,927.

(51) Int. Cl.
*B24B 1/00* (2006.01)
*B24B 49/00* (2006.01)
*B24B 51/00* (2006.01)

(52) U.S. Cl. ..... 451/5; 438/5; 451/6; 451/8; 451/10; 451/41

(58) Field of Classification Search ..... 340/680; 438/5–18; 451/4, 6, 8, 10, 36, 41, 57, 59, 451/63; 700/299
See application file for complete search history.

(56) References Cited

U.S. PATENT DOCUMENTS 4,498,345 A 2/1985 Dyer et al.
4,501,258 A 2/1985 Dyer et al.
4,502,459 A 3/1985 Dyer
4,971,021 A 11/1990 Kubotera et al.
5,036,015 A 7/1991 Sandhu et al.
5,069,002 A 12/1991 Sandhu et al.
5,081,796 A 1/1992 Schultz
5,163,334 A 11/1992 Li et al.
5,222,329 A 6/1993 Yu
5,232,875 A 8/1993 Tuttle et al.
5,234,867 A 8/1993 Schultz et al.
5,240,552 A 8/1993 Yu et al.
5,244,534 A 9/1993 Yu et al.
5,245,790 A 9/1993 Jerbic (Continued)

OTHER PUBLICATIONS

U.S. Appl. No. 11/471,975, filed Jun. 21, 2006, Moore et al.

(Continued)

*Primary Examiner*—Timothy V Eley
(74) *Attorney, Agent, or Firm*—Perkins Coie LLP

(57) ABSTRACT

This disclosure provides methods and apparatus for predictably changing the thickness of a microfeature workpiece. One implementation provides a planarizing method in which a first workpiece is planarized in first and second planarizing processes and a total change in thickness is determined. This thickness change is modified by a thickness offset associated with the second planarizing process and a material removal rate is calculated from this modified thickness change and the time on the first planarizer. A thickness of a second microfeature workpiece is measured and a target thickness of material to be removed is determined. A target planarizing time is then determined as a function of the target thickness reduction and the material removal rate.

15 Claims, 4 Drawing Sheets

U.S. PATENT DOCUMENTS

| | | | |
|---|---|---|---|
| 5,245,796 | A | 9/1993 | Miller et al. |
| RE34,425 | E | 11/1993 | Schultz |
| 5,413,941 | A | 5/1995 | Koos et al. |
| 5,421,769 | A | 6/1995 | Schultz et al. |
| 5,433,649 | A | 7/1995 | Nishida et al. |
| 5,433,651 | A | 7/1995 | Lustig et al. |
| 5,439,551 | A | 8/1995 | Meikle et al. |
| 5,449,314 | A | 9/1995 | Meikle et al. |
| 5,486,129 | A | 1/1996 | Sandhu et al. |
| 5,514,245 | A | 5/1996 | Doan et al. |
| 5,533,924 | A | 7/1996 | Stroupe et al. |
| 5,540,810 | A | 7/1996 | Sandhu et al. |
| 5,573,442 | A | 11/1996 | Morita et al. |
| 5,609,718 | A | 3/1997 | Meikle |
| 5,618,381 | A | 4/1997 | Doan et al. |
| 5,618,447 | A | 4/1997 | Sandhu |
| 5,624,303 | A | 4/1997 | Robinson |
| 5,632,666 | A | 5/1997 | Peratello et al. |
| 5,643,048 | A | 7/1997 | Iyer |
| 5,643,060 | A | 7/1997 | Sandhu et al. |
| 5,645,471 | A | 7/1997 | Strecker |
| 5,658,183 | A | 8/1997 | Sandhu et al. |
| 5,658,190 | A | 8/1997 | Wright et al. |
| 5,663,797 | A | 9/1997 | Sandhu |
| 5,664,988 | A | 9/1997 | Stroupe et al. |
| 5,668,061 | A | 9/1997 | Herko et al. |
| 5,679,065 | A | 10/1997 | Henderson |
| 5,681,204 | A | 10/1997 | Kawaguchi et al. |
| 5,700,180 | A | 12/1997 | Sandhu et al. |
| 5,702,292 | A | 12/1997 | Brunelli et al. |
| 5,730,642 | A | 3/1998 | Sandhu et al. |
| 5,738,562 | A | 4/1998 | Doan et al. |
| 5,747,386 | A | 5/1998 | Moore |
| 5,777,739 | A | 7/1998 | Sandhu et al. |
| 5,792,709 | A | 8/1998 | Robinson et al. |
| 5,795,495 | A | 8/1998 | Meikle |
| 5,798,302 | A | 8/1998 | Hudson et al. |
| 5,807,165 | A | 9/1998 | Uzoh et al. |
| 5,830,806 | A | 11/1998 | Hudson et al. |
| 5,842,909 | A | 12/1998 | Sandhu et al. |
| 5,851,135 | A | 12/1998 | Sandhu et al. |
| 5,855,804 | A | 1/1999 | Walker |
| 5,868,896 | A | 2/1999 | Robinson et al. |
| 5,879,222 | A | 3/1999 | Robinson |
| 5,882,248 | A | 3/1999 | Wright et al. |
| 5,893,754 | A | 4/1999 | Robinson et al. |
| 5,895,550 | A | 4/1999 | Andreas |
| 5,910,846 | A | 6/1999 | Sandhu |
| 5,934,973 | A | 8/1999 | Boucher et al. |
| 5,934,980 | A | 8/1999 | Koos et al. |
| 5,936,733 | A | 8/1999 | Sandhu et al. |
| 5,945,347 | A | 8/1999 | Wright |
| 5,954,912 | A | 9/1999 | Moore |
| 5,967,030 | A | 10/1999 | Blalock |
| 5,972,792 | A | 10/1999 | Hudson |
| 5,980,363 | A | 11/1999 | Meikle et al. |
| 5,981,396 | A | 11/1999 | Robinson et al. |
| 5,994,224 | A | 11/1999 | Sandhu et al. |
| 5,997,384 | A | 12/1999 | Blalock |
| 6,006,739 | A | 12/1999 | Akram et al. |
| 6,007,408 | A | 12/1999 | Sandhu |
| 6,039,633 | A | 3/2000 | Chopra |
| 6,040,245 | A | 3/2000 | Sandhu et al. |
| 6,046,111 | A | 4/2000 | Robinson |
| 6,054,015 | A | 4/2000 | Brunelli et al. |
| 6,057,602 | A | 5/2000 | Hudson et al. |
| 6,066,030 | A | 5/2000 | Uzoh |
| 6,074,286 | A | 6/2000 | Ball |
| 6,083,085 | A | 7/2000 | Lankford |
| 6,108,092 | A | 8/2000 | Sandhu |
| 6,110,820 | A | 8/2000 | Sandhu et al. |
| 6,116,988 | A | 9/2000 | Ball |
| 6,120,354 | A | 9/2000 | Koos et al. |
| 6,125,255 | A | 9/2000 | Litman |
| 6,135,856 | A | 10/2000 | Tjaden et al. |
| 6,139,402 | A | 10/2000 | Moore |
| 6,143,123 | A | 11/2000 | Robinson et al. |
| 6,143,155 | A | 11/2000 | Adams et al. |
| 6,152,803 | A | 11/2000 | Boucher et al. |
| 6,152,808 | A | 11/2000 | Moore |
| 6,176,992 | B1 | 1/2001 | Talieh |
| 6,183,345 | B1 | 2/2001 | Kamono et al. |
| 6,184,571 | B1 | 2/2001 | Moore |
| 6,187,681 | B1 | 2/2001 | Moore |
| 6,190,494 | B1 | 2/2001 | Dow |
| 6,191,037 | B1 | 2/2001 | Robinson |
| 6,191,864 | B1 | 2/2001 | Sandhu |
| 6,193,588 | B1 | 2/2001 | Carlson et al. |
| 6,193,923 | B1 | 2/2001 | Leyden et al. |
| 6,200,901 | B1 | 3/2001 | Hudson et al. |
| 6,203,404 | B1 | 3/2001 | Joslyn et al. |
| 6,203,407 | B1 | 3/2001 | Robinson |
| 6,203,413 | B1 | 3/2001 | Skrovan |
| 6,206,754 | B1 | 3/2001 | Moore |
| 6,206,756 | B1 | 3/2001 | Chopra et al. |
| 6,206,769 | B1 | 3/2001 | Walker |
| 6,208,425 | B1 | 3/2001 | Sandhu et al. |
| 6,210,257 | B1 | 4/2001 | Carlson |
| 6,211,094 | B1 | 4/2001 | Jun et al. |
| 6,213,845 | B1 | 4/2001 | Elledge |
| 6,218,316 | B1 | 4/2001 | Marsh |
| 6,224,466 | B1 | 5/2001 | Walker et al. |
| 6,227,955 | B1 | 5/2001 | Custer et al. |
| 6,230,069 | B1 | 5/2001 | Campbell et al. |
| 6,234,874 | B1 | 5/2001 | Ball |
| 6,234,877 | B1 | 5/2001 | Koos et al. |
| 6,234,878 | B1 | 5/2001 | Moore |
| 6,237,483 | B1 | 5/2001 | Blalock |
| 6,250,994 | B1 | 6/2001 | Chopra et al. |
| 6,251,785 | B1 | 6/2001 | Wright |
| 6,261,151 | B1 | 7/2001 | Sandhu et al. |
| 6,261,163 | B1 | 7/2001 | Walker et al. |
| 6,267,650 | B1 | 7/2001 | Hembree |
| 6,273,786 | B1 | 8/2001 | Chopra et al. |
| 6,273,796 | B1 | 8/2001 | Moore |
| 6,276,996 | B1 | 8/2001 | Chopra |
| 6,287,879 | B1 | 9/2001 | Gonzales et al. |
| 6,290,572 | B1 | 9/2001 | Hofmann |
| 6,301,006 | B1 | 10/2001 | Doan |
| 6,306,012 | B1 | 10/2001 | Sabde |
| 6,306,014 | B1 | 10/2001 | Walker et al. |
| 6,306,768 | B1 | 10/2001 | Klein |
| 6,312,558 | B2 | 11/2001 | Moore |
| 6,313,038 | B1 | 11/2001 | Chopra et al. |
| 6,319,420 | B1 | 11/2001 | Dow |
| 6,323,046 | B1 | 11/2001 | Agarwal |
| 6,328,632 | B1 | 12/2001 | Chopra |
| 6,331,488 | B1 | 12/2001 | Doan et al. |
| 6,338,667 | B2 | 1/2002 | Sandhu et al. |
| 6,350,180 | B2 | 2/2002 | Southwick |
| 6,350,691 | B1 | 2/2002 | Lankford |
| 6,352,466 | B1 | 3/2002 | Moore |
| 6,354,923 | B1 | 3/2002 | Lankford |
| 6,354,930 | B1 | 3/2002 | Moore |
| 6,358,122 | B1 | 3/2002 | Sabde et al. |
| 6,358,127 | B1 | 3/2002 | Carlson et al. |
| 6,358,129 | B2 | 3/2002 | Dow |
| 6,361,417 | B2 | 3/2002 | Walker et al. |
| 6,362,105 | B1 | 3/2002 | Moore |
| 6,364,746 | B2 | 4/2002 | Moore |
| 6,364,757 | B2 | 4/2002 | Moore |
| 6,368,190 | B1 | 4/2002 | Easter et al. |
| 6,368,193 | B1 | 4/2002 | Carlson et al. |
| 6,368,194 | B1 | 4/2002 | Sharples et al. |

6,368,197 B2 4/2002 Elledge
6,376,381 B1 4/2002 Sabde
6,383,934 B1 5/2002 Sabde et al.
6,387,289 B1 5/2002 Wright
6,395,620 B1 5/2002 Pan et al.
6,402,884 B1 6/2002 Robinson et al.
6,428,386 B1 8/2002 Bartlett
6,444,481 B1 9/2002 Pasadyn
6,447,369 B1 9/2002 Moore
6,492,273 B1 12/2002 Hofmann et al.
6,498,101 B1 12/2002 Wang
6,505,090 B1 1/2003 Harakawa
6,511,576 B2 1/2003 Klein
6,514,865 B1 2/2003 Evans
6,517,412 B2 2/2003 Lee et al.
6,520,834 B1 2/2003 Marshall
6,533,893 B2 3/2003 Sabde et al.
6,537,133 B1 3/2003 Birang et al.
6,546,306 B1 4/2003 Bushman et al.
6,547,640 B2 4/2003 Hofmann
6,548,407 B1 4/2003 Chopra et al.
6,579,799 B2 6/2003 Chopra et al.
6,586,261 B1 7/2003 Ishizuka et al.
6,592,443 B1 7/2003 Kramer et al.
6,602,117 B1 8/2003 Chopra et al.
6,609,947 B1 8/2003 Moore
6,612,901 B1 9/2003 Agarwal
6,623,329 B1 9/2003 Moore
6,628,410 B2 9/2003 Doan
6,633,084 B1 10/2003 Sandhu et al.
6,652,764 B1 11/2003 Blalock
6,666,749 B2 12/2003 Taylor
6,794,200 B2 9/2004 Ishizuka et al.
6,827,629 B2 12/2004 Kim et al.
6,857,938 B1 2/2005 Smith et al.
7,086,927 B2 8/2006 Moore et al.

OTHER PUBLICATIONS

Applied Materials, Inc., Mirra Mesa Advanced Integrated CMP, 2 pages, retrieved from the Internet on Jun. 22, 2003, <http://www.amat.com/products/mirra_mesa.html>.

Zhang, J. et al., "Automated Process Control of Within-Wafer and Wafer-to-Wafer Uniformity in Oxide CMP," 6 pages, Mar. 2002, <http://www.amat.com/Products/CMP_Tech_Papers.html>.

METHODS FOR PLANARIZING WORKPIECES, E.G., MICROELECTRONIC WORKPIECES

This application is a continuation of U.S. patent application Ser. No. 10/796,257 filed Mar. 9, 2004, now U.S. Pat. No. 7,086,927 issued Aug. 8, 2006, which is incorporated herein by reference in its entirety.

TECHNICAL FIELD

The present invention provides certain improvements in processing microfeature workpieces. The invention has particular utility in connection with planarizing microfeature workpieces, e.g., semiconductor wafers.

BACKGROUND

Mechanical and chemical-mechanical planarizing processes (collectively "CMP processes") remove material from the surface of semiconductor wafers, field emission displays, or other microfeature workpieces in the production of microelectronic devices and other products. FIG. 1 schematically illustrates a CMP machine 10 with a platen 20, a carrier assembly 30, and a planarizing pad 40. The CMP machine 10 may also have an under-pad 25 attached to an upper surface 22 of the platen 20 and the lower surface of the planarizing pad 40. A drive assembly 26 rotates the platen 20 (indicated by arrow F), or it reciprocates the platen 20 back and forth (indicated by arrow G). Since the planarizing pad 40 is attached to the under-pad 25, the planarizing pad 40 moves with the platen 20 during planarization.

The carrier assembly 30 has a head 32 to which a microfeature workpiece 12 may be attached, or the microfeature workpiece 12 may be attached to a resilient pad 34 in the head 32. The head 32 may be a free-floating wafer carrier, or an actuator assembly 36 may be coupled to the head 32 to impart axial and/or rotational motion to the workpiece 12 (indicated by arrows H and 1, respectively).

The planarizing pad 40 and a planarizing solution 44 on the pad 40 collectively define a planarizing medium that mechanically and/or chemically removes material from the surface of the workpiece 12. The planarizing pad 40 can be a soft pad or a hard pad. The planarizing pad 40 can also be a fixed-abrasive planarizing pad in which abrasive particles are fixedly bonded to a suspension material. In fixed-abrasive applications, the planarizing solution 44 is typically a non-abrasive "clean solution" without abrasive particles. In other applications, the planarizing pad 40 can be a non-abrasive pad composed of a polymeric material (e.g., polyurethane), resin, felt, or other suitable materials. The planarizing solutions 44 used with the non-abrasive planarizing pads are typically abrasive slurries with abrasive particles suspended in a liquid. The planarizing solution may be replenished from a planarizing solution supply 46.

In chemical-mechanical planarization (as opposed to solely mechanical planarization), the planarizing solution 44 will typically chemically interact with the surface of the workpiece 12 to control the removal rate or otherwise optimize the removal of material from the surface of the workpiece. Increasingly, microfeature device circuitry (i.e., trenches, vias, and the like) is being formed from copper. When planarizing a copper layer using a CMP process, the planarizing solution 44 is typically neutral to acidic and includes an oxidizer (e.g., hydrogen peroxide) to oxidize the copper and increase the copper removal rate. One particular slurry useful for polishing a copper layer is disclosed in International Publication Number WO 02/18099, the entirety of which is incorporated herein by reference.

To planarize the workpiece 12 with the CMP machine 10, the carrier assembly 30 presses the workpiece 12 face-downward against the planarizing medium. More specifically, the carrier assembly 30 generally presses the workpiece 12 against the planarizing solution 44 on a planarizing surface 42 of the planarizing pad 40, and the platen 20 and/or the carrier assembly 30 move to rub the workpiece 12 against the planarizing surface 42. As the workpiece 12 rubs against the planarizing surface 42, material is removed from the face of the workpiece 12. In some common CMP machines 10, the pressure of the workpiece 12 against the planarizing medium may be gradually ramped up and/or ramped down over a period of time instead of immediately pressing the workpiece against the planarizing medium with full force and immediately terminating pressure when the planarizing step is complete.

CMP processes should consistently and accurately produce a uniformly planar surface on the workpiece to enable precise fabrication of circuits and photo-patterns. During the construction of transistors, contacts, interconnects and other features, many workpieces develop large "step heights" that create highly topographic surfaces. Such highly topographical surfaces can impair the accuracy of subsequent photolithographic procedures and other processes that are necessary for forming sub-micron features. For example, it is difficult to accurately focus photo patterns to meet tolerances approaching 0.1 micron on topographic surfaces because sub-micron photolithographic equipment generally has a very limited depth of field. Thus, CMP processes are often used to transform a topographical surface into a highly uniform, planar surface at various stages of manufacturing microfeature devices on a workpiece.

In the highly competitive semiconductor industry, it is also desirable to maximize the throughput of CMP processing by producing a planar surface on a substrate as quickly as possible. The throughput of CMP processing is a function, at least in part, of the ability to accurately stop CMP processing at a desired endpoint. In a typical CMP process, the desired endpoint is reached when the surface of the substrate is planar and/or when enough material has been removed from the substrate to form discrete components on the substrate (e.g., shallow trench isolation areas, contacts and damascene lines). Accurately stopping CMP processing at a desired endpoint is important for maintaining a high throughput because the substrate assembly may need to be re-polished if it is "under-planarized," or components on the substrate may be destroyed if it is "over-polished." Thus, it is highly desirable to stop CMP processing at the desired endpoint.

In one conventional method for determining the endpoint of CMP processing, the planarizing period of a particular substrate is determined using an estimated polishing rate based upon the polishing rate of identical substrates that were planarized under similar conditions. The estimated planarizing period for a particular substrate, however, may not be accurate because the polishing rate or other variables may change from one substrate to another.

To compensate for changes in planarizing conditions (e.g., degradation of the planarizing pad 40, variations in the composition of the planarizing solution 44, or temperature fluctuations), conventional CMP tools predict the estimated planarizing time for the next workpiece 12 using a calculated material removal rate from the preceding workpiece or several preceding workpieces. Typically, this will involve measuring the thickness of the workpiece in a pre-planarizing metrology tool, planarizing the workpiece on the CMP machine 10, and measuring the thickness of the workpiece again in a post-planarizing metrology tool. Dividing the change in the measured thickness by the time spent planarizing a microfeature workpiece 12 can determine the material removal rate for that particular workpiece. The calculated removal rate may be used as an estimated removal rate for the next workpiece on the assumption that the planarizing conditions will not change too greatly between two sequentially processed workpieces.

To mask statistical variation from one workpiece to another, many CMP machines 10 use an exponentially weighted moving average of material removal rates from a series of microfeature workpieces to predict the material removal rate for the next workpiece. Aspects of such exponentially weighted moving average controllers, among other CMP controllers, are described in some detail in U.S. Pat. No. 6,230,069, the entirety of which is incorporated herein by reference.

Some commercially available CMP machines employ two different types of planarizing pads 40, each mounted on a separate platen 20. A first planarizing pad may remove material at a relatively fast rate and a second planarizing pad may be a finishing pad that removes material at a slower rate to yield a highly polished surface. Applied Materials Corporation of California, USA, sells one such CMP machine under the trade name MIRRA MESA. To increase throughput, the MIRRA MESA CMP tool includes two rough planarizing pads and one finishing pad. The material removal rate for the MIRRA MESA machine is calculated in much the same fashion as other conventional CMP machines, i.e., the total change in thickness as a result of processing on the CMP machine is divided by the combined primary planarizing time on the two rough planarizing pads, which tends to be the only planarizing time that is adjusted from one workpiece to the next.

To estimate the planarizing time necessary to planarize an incoming microfeature workpiece, the thickness of the top layer(s) on the incoming workpiece can be measured to determine the amount of material that needs to be removed. The estimated planarizing time may then be calculated using the formula:

$$t_{in} = t + \frac{KE + K_{in}\Delta T_{in} + rI(E')}{RR}$$

wherein:

$t_{in}$ is the estimated planarizing time of an incoming workpiece;

t is the actual planarizing time of the preceding workpiece;

K is an empirically determined constant;

E is the difference between the predicted final thickness of the preceding workpiece and the thickness actually measured by the post-planarizing metrology tool;

$K_{in}$ is another empirically determined constant;

$\Delta T_{in}$ is the thickness of the material to be removed from the incoming workpiece;

r is another empirically determined constant;

I(E') is an integral function (e.g., of the type commonly employed in PID control systems) of the difference between a predicted final thickness and the actually measured thickness for a series of preceding workpieces; and RR is the calculated removal rate. This calculated removal rate may be the removal rate for the immediately preceding workpiece or may be an average, e.g., an exponentially weighted moving average, of a number of preceding workpieces.

The estimated planarizing time calculated in such a fashion can be a reasonably accurate estimate if the amount of material to be removed from the workpiece is relatively large, e.g., several thousand angstroms. With advances in the design of workpieces, the layers of material being removed in the CMP process is decreasing over time, with some CMP processes removing less than 1,000 Å. The conventional techniques outlined above for estimating the planarizing time for a given workpiece are proving less accurate at predicting material removal rate as the amount of material being removed is reduced. This greater variability in calculated removal time, together with the reduced amount of material being removed, can lead to materially under-planarizing or over-planarizing the workpieces.

DETAILED DESCRIPTION

Figure 1:
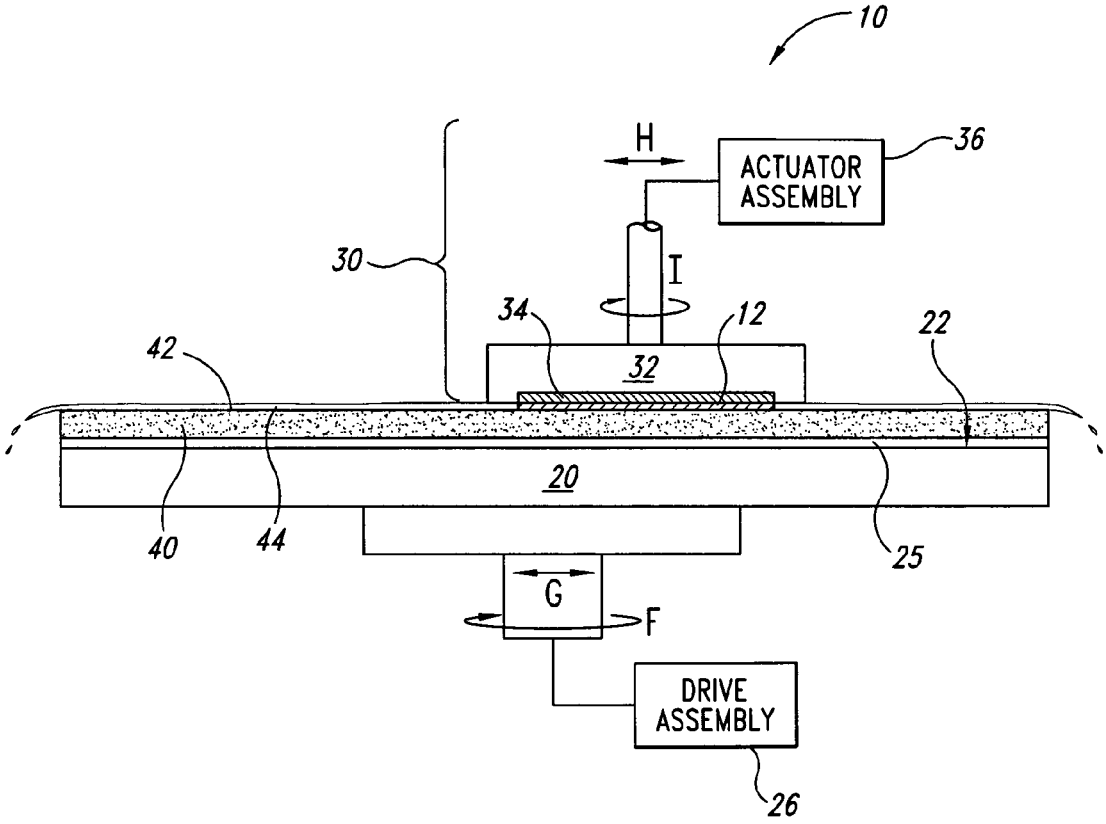
Fig. 1 (Prior Art)
FIG. 1 is a schematic cross-sectional view of a planarizing machine in accordance with the prior art.

Various embodiments of the present invention provide methods and apparatus for processing microfeature workpieces. The term "microfeature workpiece" is used throughout to include substrates upon which and/or in which microelectronic devices, micromechanical devices, data storage elements, read/write components, and other features are fabricated. For example, microfeature workpieces can be semiconductor wafers such as silicon or gallium arsenide wafers, glass substrates, insulative substrates, and many other types of materials. The microfeature workpieces typically have submicron features with dimensions of 0.05 microns or greater. Many specific details of the invention are described below with reference to rotary planarizing machines; the present invention can also be practiced using other types of planarizing machines (e.g., web-format planarizing machines). The following description provides specific details of certain embodiments of the invention illustrated in the drawings to provide a thorough understanding of those embodiments. It should be recognized, however, that the present invention can be reflected in additional embodiments and the invention may be practiced without some of the details in the following description.

A. Overview

A microfeature workpiece planarizing system in accordance with one embodiment of the invention includes a carrier assembly, a first planarizer, a second planarizer, a microfeature workpiece transport, and a programmable controller. The first and second planarizers can be first and second planarizing stations of a single tool that are serviced by a single load/unload device, or the first and second planarizers can be separate planarizing tools with separate load/unload devices.

The carrier assembly is adapted to hold a microfeature workpiece. The first planarizer includes a first planarizing medium comprising a first planarizing solution and a first planarizing pad, and the second planarizer includes a second planarizing medium comprising a second planarizing solution and a second planarizing pad. The second planarizing medium is different from the first planarizing medium. The microfeature workpiece transport is adapted to transfer a microfeature workpiece from the first planarizer to the second planarizer. The controller is programmed to:

receive thickness change information indicative of a change in thickness caused by planarizing a preceding microfeature workpiece in a first process with the first planarizer and in a second process with at least one of the first and second planarizers;

determine a modified thickness change by reducing the change in thickness by a thickness offset associated with material removal by the at least one second planarizer;

determine a material removal factor for the preceding microfeature workpiece as a function of the modified thickness change and a planarizing time of the preceding microfeature workpiece on the first planarizer;

receive initial thickness information indicative of a target thickness change for an incoming microfeature workpiece;

estimate a target planarizing time for the first process as a function of the target thickness change and the material removal factor; and cause the first planarizer to planarize the incoming microfeature workpiece for the target planarizing time.

Another embodiment of the invention provides a method for processing a microfeature workpiece in which a first microfeature workpiece is subjected to a first process for a first process time. The first process changes a thickness of the first microfeature workpiece from the first pre-processing thickness at a first rate. The first microfeature workpiece is also subjected to a second process for a second process time, with the second process changing the thickness of the first microfeature workpiece at a second rate that differs from the first rate. A thickness change of the first microfeature workpiece attributable to both the first process and the second process is determined and this thickness change is offset by a thickness offset associated with the second process. A thickness change factor is determined for the first microfeature workpiece as a ratio of the offset thickness change and the first processing time. A second pre-processing thickness of a second microfeature workpiece is measured and a thickness change target is determined for the second microfeature workpiece by comparing the second pre-processing thickness with a target thickness of the second microfeature workpiece. A target processing time for the second microfeature workpiece is determined as a function of the thickness change target and the thickness change factor. The second microfeature workpiece is subjected to the first process for the target processing time and to the second process for a third planarizing time.

For ease of understanding, the following discussion is broken down into two areas of emphasis. The first section discusses various apparatus in accordance with embodiments of the invention. The second section outlines methods in accordance with other embodiments of the invention.

B. Apparatus

Figure 2:
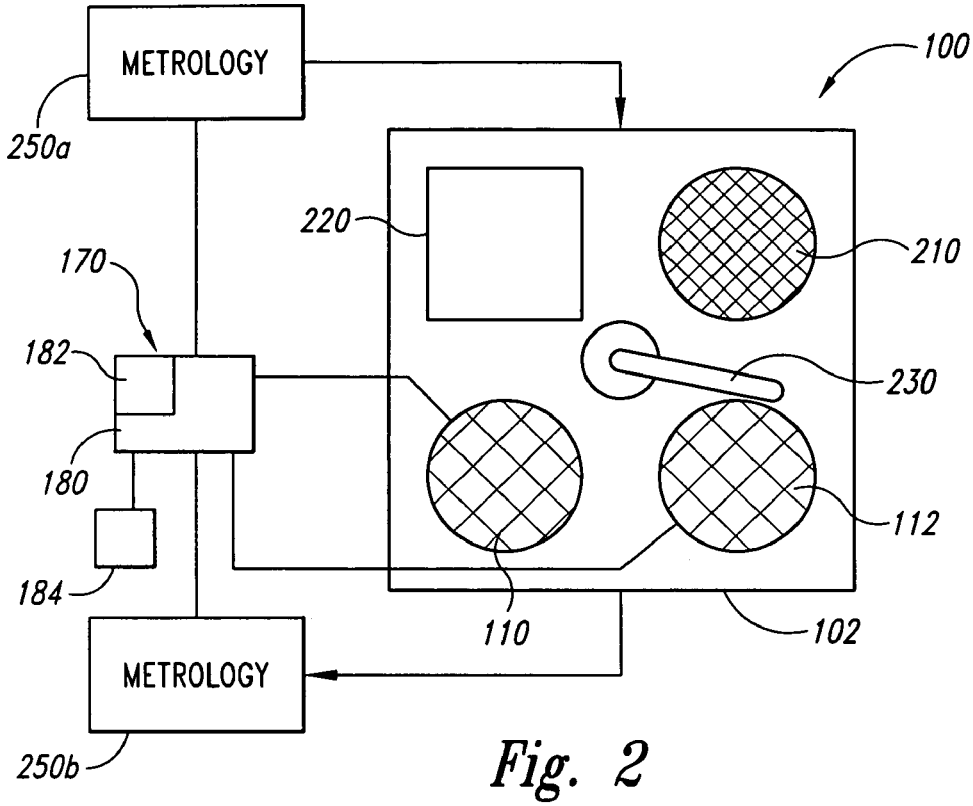
FIG. 2 is a schematic overview of a planarizing system in accordance with an embodiment of the invention.
Figure 3:
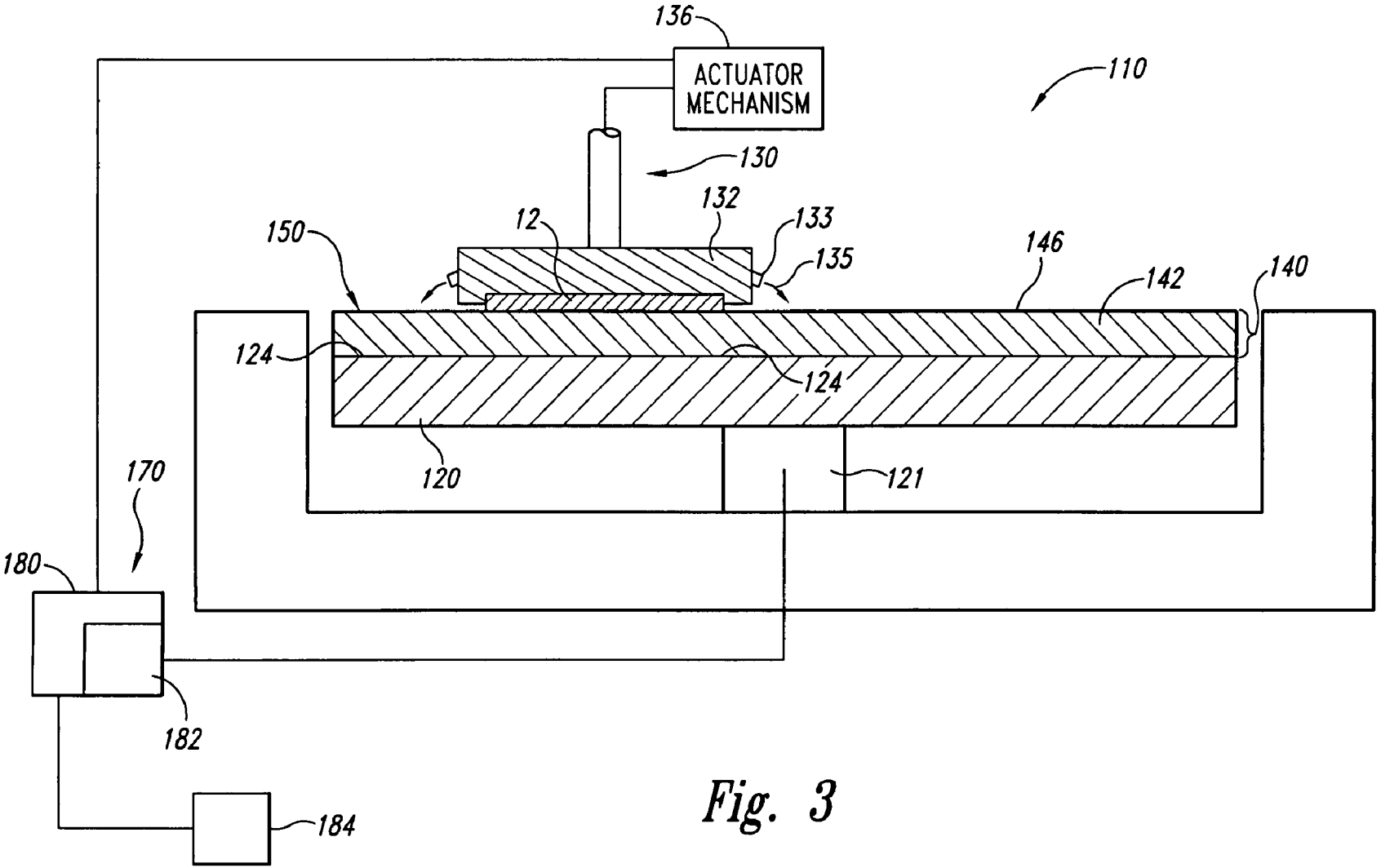
FIG. 3 is a schematic cross-sectional view of a main planarizer of the planarizing system shown in FIG. 2.

FIGS. 2 and 3 schematically illustrate aspects of a planarizing system 100 in accordance with one embodiment of the invention. FIG. 2 is an overview of the planarizing system 100 and FIG. 3 is a cross-sectional view of a planarizer 110. Many features of the planarizing system 100 and planarizer 110 are shown schematically in these drawings.

The planarizing system 100 of FIG. 2 includes a planarizing machine 102 including a main planarizer 110 and a finishing planarizer 210. The planarizing machine 102 may also include a second main planarizer 112, similar to the arrangement of the MIRRA MESA CMP machine noted above. A workpiece transport 230 (shown schematically) may be used to move a microfeature workpiece between a load/unload unit 220 (e.g., a supply cassette or washing station) and the planarizers 110, 112, and 210. The workpiece transport 230 can have a carrier assembly for each of the planarizers 110, 112, and 210 such that the planarizers can operate concurrently to simultaneously remove material from a plurality of different workpieces.

The planarizing system 100 of FIG. 2 also includes a pre-planarizing metrology station 250*a* and a post-planarizing metrology station 250*b*. Suitable metrology systems adapted to measure the thicknesses of microfeature workpieces are commercially available from a variety of sources. Although FIG. 2 illustrates two separate metrology stations 250*a* and 250*b*, a single metrology station could instead measure both the pre-planarizing thickness and the post-planarizing thickness of the microfeature workpieces.

The planarizing system 100 of FIG. 2 also includes a control system 170 comprising a controller 180. The controller 180 may include a programmable processor 182 and a computer-readable program 184 that causes the controller 180 to control operation of other elements of the planarizing system 100. The controller 180 may take the form of a single computer or a plurality of computers arranged in a network.

In the illustrated embodiment, the controller 180 is operatively connected to the pre- and post-planarizing metrology stations 250*a-b* and is adapted to receive metrology information from the metrology stations 250*a-b*. The metrology information is indicative of a change in thickness of the workpiece resulting from planarizing. In one embodiment, the metrology information received by the controller 180 may be the actual thickness change. In another embodiment, the metrology information includes a pre-planarizing thickness of a microfeature workpiece or layer(s) on a microfeature workpiece as measured by the pre-planarizing metrology station 250*a* and/or a post-planarizing thickness for the microfeature workpiece as measured by the post-planarizing metrology station 250*b*. The metrology stations 250 may provide thickness data for a particular workpiece as a single number, which may represent an average thickness across the workpiece surface, or as a set of data representing a plurality of thickness measurements from different locations on the workpiece surface.

The controller 180 may also be operatively coupled to one or more of the first main planarizer 110, the second main planarizer 112, and the finishing planarizer 210. In some embodiments, the controller 180 need not be operatively coupled to the finishing planarizer 210. In many anticipated embodiments, the controller 180 is operatively connected to at least one, if not both, of the first and second main planarizers 110 and 112.

Figure 2A:
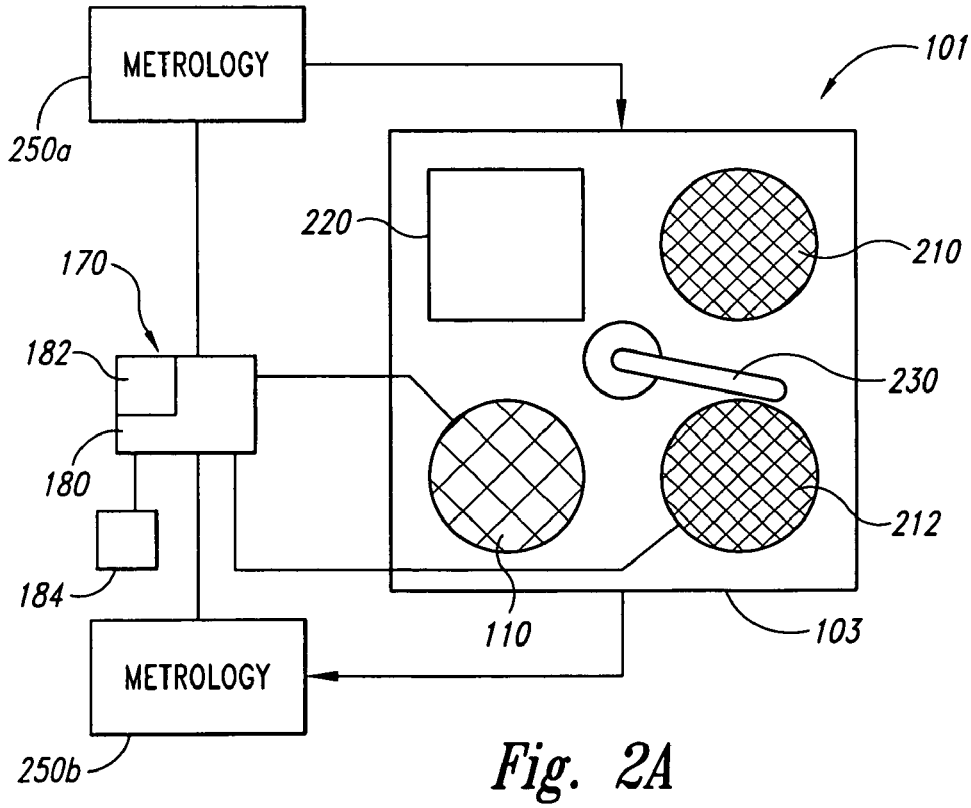
FIG. 2A is a schematic overview, similar to FIG. 2, of a planarizing system in accordance with an alternative embodiment of the invention.

FIG. 2A schematically illustrates a planarizing system 101 in accordance with an alternative embodiment of the invention. Most of the elements of the planarizing system 101 may be directly analogous to elements of the planarizing system 100 of FIG. 2 and like reference numbers are used in FIGS. 2 and 2A to identify like elements. One difference between the planarizing systems 100 and 101 is that the planarizing machine 102 of FIG. 2 includes two main planarizers 110 and 112 and a single finishing planarizer 210, but the planarizing machine 103 of FIG. 2A includes a single main planarizer 110 and first and second finishing planarizers 210 and 212, respectively.

FIG. 3 shows the first planarizer 110 of the planarizing machine 102 in greater detail. In the illustrated embodiment, the first planarizer 110 includes a table or platen 120 coupled to a drive mechanism 121 that rotates the platen 120. The platen 120 can include a support surface 124. The planarizing machine 102 can also include a carrier assembly 130 having a workpiece holder 132 or head coupled to an actuator mechanism 136. The workpiece holder 132 holds and controls a workpiece 12 during a planarizing cycle. The workpiece holder 132 can include a plurality of nozzles 133 through which a planarizing solution 135 can flow during a planarizing cycle. The carrier assembly 130 can be substantially the same as the carrier assembly 30 described above with reference to FIG. 1.

The planarizing machine 102 can also include a planarizing medium 150 comprising the planarizing solution 135 and a planarizing pad 140 having a planarizing body 142. The planarizing body 142 can be formed of an abrasive or non-abrasive material having a planarizing surface 146. For example, an abrasive planarizing body 142 can have a resin matrix (e.g., a polyurethane resin) and a plurality of abrasive particles fixedly attached to the resin matrix. Suitable abrasive planarizing bodies 142 are disclosed in U.S. Pat. Nos. 5,645,471; 5,879,222; 5,624,303; 6,039,633; and 6,139,402, each of which is incorporated herein in its entirety by reference.

The controller 180 of the control system 170 may be operatively coupled to the drive mechanism 121 of the platen 120 and to the actuator mechanism 136 of the carrier assembly 130, as shown. The controller 180 may control a parameter of the drive mechanism 121 and/or the actuator mechanism 136, e.g., by starting and stopping the drive mechanism in accordance with a calculated polishing time. In one embodiment, the controller 180 calculates this polishing time in accordance with one of the methods outlined below. The program 184 can be contained on a computer-readable medium stored in the controller 180.

Although FIG. 3 illustrates only the first main planarizer 110, the structure and operation of the second main planarizer 112 (FIG. 2), the finishing planarizer 210, and the second finishing planarizer 212 (FIG. 2A) may be similar to that of the main planarizer 110 shown in FIG. 3. The difference between the finishing planarizers (210 and 212) and the main planarizers (110 and 112) is that the finishing planarizers typically perform a less aggressive polishing process than the main planarizers. For example, the finishing planarizer 210 of FIG. 2 typically uses only mild abrasives and/or less downforce to smooth the finished surface by reducing or eliminating surface asparities caused by the more aggressive main planarizers 110 and 112. The finishing planarizer accordingly often has a different planarizing pad 140 or a different planarizing solution 135 than the main planarizers 110 and 112. This allows the removal rate of the finishing planarizer 210 to be independent from the removal rate of the main planarizer so that the main planarizers 110 and 112 have a higher removal rate and the finishing planarizer 210 provides a more polished surface.

C. Methods of Controlling Planarizing

As noted above, other embodiments of the invention provide methods of processing a microfeature workpiece 12. In the following discussion, reference is made to the planarizing system 100 illustrated in FIGS. 2 and 3. It should be understood, though, that reference to this particular planarizing system is solely for purposes of illustration and that the methods outlined below are not limited to any particular planarizing system shown in the drawings or discussed in detail above.

Figure 4:
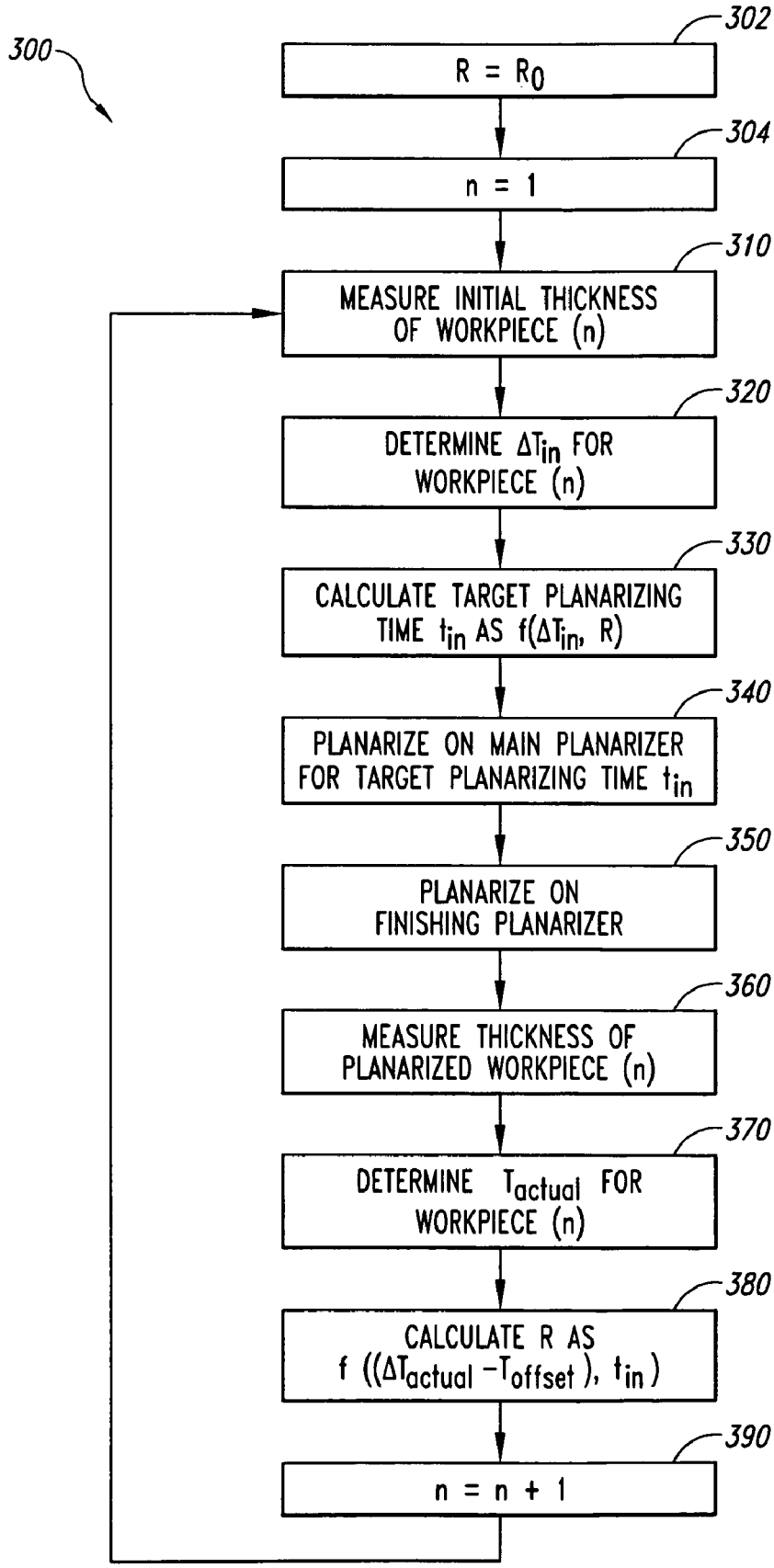
FIG. 4 is a flow diagram schematically illustrating a planarizing process in accordance with another embodiment of the invention.

FIG. 4 schematically illustrates a microfeature workpiece processing method 300 in accordance with one embodiment of the invention. At the outset, a material removal factor R may be initialized at a predetermined value $R_0$ in a process 302. As explained below, this material removal factor R may comprise an anticipated material removal rate for planarizing on the main planarizer 110. The initial value $R_0$ may be determined empirically for the type of microfeature workpiece 12 being processed and the nominal processing conditions (e.g., temperature, planarizing media characteristics, and downforce of the carrier 130). Alternatively, the initial value $R_0$ may comprise a material removal factor calculated for the same system at the end of a previous batch of microfeature workpieces 12.

In the particular method 300 shown in FIG. 4, a batch of microfeature workpieces 12 may be processed sequentially. If so desired, the number n of the workpiece within the batch of workpieces may be initialized at a value of one in process 304.

The initial thickness of the first microfeature workpiece 12 in the batch of workpieces may be measured with the pre-planarizing metrology station 250*a* in process 310. As noted, this thickness measurement may be provided to the controller 180 as a single average number or as a set of data reflecting a series of measurements from different locations on a surface of the microfeature workpiece 12. As is known in the art, the "thickness" measurements by the metrology station 250*a* may be a measurement of the total thickness of the microfeature workpiece 12 or a thickness of select layer(s) on the microfeature workpiece 12. Alternatively, the thickness may be measured as an offset from a known plane within the metrology system 250*a*.

The controller 180 may then determine a target thickness change for the incoming first microfeature workpiece 12 in process 320, which may include comparing the initial thickness measurement for the workpiece from process 310 to a target thickness for the microfeature workpiece 12. For example, a nominal target thickness for all of the microfeature workpieces 12 may be programmed in the controller 180 and subtracted from the initial thickness measured in process 310. In one particular embodiment, the target thickness change ($\Delta T_{in}$) may be reduced by a predetermined thickness offset $T_{offset}$, as discussed below. The resultant reduced target thickness change ($\Delta T_{reduced}=\Delta T_{in}-T_{offset}$) may more accurately reflect the desired thickness change resulting from planarizing by the main planarizer 110 (or planarizers 110 and 112).

In process 330, the controller 180 may calculate a target planarizing time $t_{in}$ for the incoming microfeature workpiece 12 as a function of the target thickness change $\Delta T_{in}$ or $\Delta T_{reduced}$ and the material removal factor R. If the material removal factor R is correlated to a material removal rate (e.g., Å/sec), the target planarizing time $t_{in}$ may comprise the target thickness change $\Delta T_{in}$ or $\Delta T_{reduced}$ divided by this material removal rate R. If the material removal rate is instead determined as a function of the time necessary to remove a given thickness (e.g., sec/ÅÅ), the target thickness change $\Delta T_{in}$ or $\Delta T_{reduced}$ may be multiplied by this material removal factor R.

The controller 180 may then control operation of the main planarizer 110 to planarize the microfeature workpiece 12 for the target planarizing time $t_{in}$. The controller 180 may terminate planarizing of the microfeature workpiece 12 at the end of the target planarizing time $t_{in}$ by sending a stop signal to the actuator mechanism 136 of the carrier assembly 130 and/or to the drive mechanism 121 of the platen 120.

As noted previously, planarizing the microfeature workpiece 112 generally comprises pressing the workpiece 112 against the planarizing medium 150 in a controlled manner. In one particular embodiment of the invention, the pressure is gradually ramped up and/or ramped down instead of suddenly applied at the beginning of the planarizing cycle and suddenly ended when the stop signal is generated. The controller 180 or another aspect of the planarizing system 100 in this embodiment may ramp up the pressure before the target planarizing time $t_{in}$ begins and ramp down the pressure at the end of the target planarizing time $t_{in}$. Other ramp-up and ramp-down processes may employ a substantially constant pressure, but allow stabilization of other control parameters (e.g., temperature) before and/or after the target planarizing time $t_{in}$. The ramp-up and ramp-down processes may be substantially the same from one workpiece to the next. This ramp-up and ramp-down time, which may be considered a secondary planarizing on the main planarizer 110, typically will remove material appreciably more slowly than in the main planarizing process 340 conducted at the full pressure for the target planarizing time $t_{in}$.

In addition to, or instead of, such ramp-up and ramp-down processes, the planarizing process may include a variety of other secondary planarizing processes. For example, microfeature workpieces 12 may be subjected to a main planarizing step and a separate edge planarizing step that is targeted to polish a peripheral region of the microfeature workpieces 12. In one embodiment, such edge planarizing may be considered a secondary planarizing step carried out on the main planarizer 110 and the edge planarizing time is not included in the target planarizing time $t_{in}$. In an alternative embodiment, the edge planarizing process may be considered part of the main planarizing process 340 and the target planarizing time $t_{in}$ may include the time spent on the main planarizer both in generally planarizing the microfeature workpiece 12 and in the edge planarizing process.

In some embodiments, the planarizing machine 102 includes both a first main planarizer 110 and a second main planarizer 112. If each microfeature workpiece 12 is subjected to a main planarizing process only on one of these planarizers 110 and 112, each microfeature workpiece 12 may remain on the main planarizer 110 or 112 for the full target planarizing time $t_{in}$. In other embodiments, each microfeature workpiece 12 may be planarized by both of the main planarizers 110 and 112 in sequence before being planarized by the finishing planarizer 210. In such an embodiment, the target planarizing time $t_{in}$ may be allocated between the two main planarizers 110 and 112 in any desired fashion, e.g., by planarizing microfeature workpieces 12 for an equal time on each of the main planarizers 110 and 112. If microfeature workpieces 12 are to be planarized on both of the main planarizers 110 and 112, a secondary planarizing may be employed to ramp up and ramp down the applied planarizing pressure on each of the main planarizers 110 and 112.

After being planarized on the main planarizer(s) in the first planarizing process 340, the microfeature workpiece 12 may be planarized on the finishing planarizer 210 in a second planarizing process 350. In one embodiment, the planarizing time on the finishing planarizer 210 may remain substantially constant over the entire run of the batch of microfeature workpieces 12. In other embodiments, this time may be varied from one microfeature workpiece to the next in accordance with a predetermined profile. If the planarizing machine includes a second finishing planarizer 212 (FIG. 2A), the time of the second planarizing process 350 may be divided between the two finishing planarizers 210 and 212. In select embodiments, the second planarizing process 350 may include not only planarizing on the finishing planarizer(s) 210 and/or 212, but also the secondary planarizing reflected by the ramp-up and ramp-down procedures noted above. In one embodiment, the second planarizing process 350 may be considered to include all planarizing, on any planarizer (110, 112, 210, and/or 212), other than that reflected in the main planarizing process 340.

After the first and second planarizing processes 340 and 350, the thickness of the planarized workpiece may be measured in a post-planarizing thickness measuring process 360. This post-planarizing thickness may be compared to the pre-planarizing thickness measured in process 310 to determine the actual change in thickness $\Delta T_{actual}$ for the workpiece in process 370. This actual change in thickness $\Delta T_{actual}$ may be determined, for example, by subtracting the post-planarizing thickness measurement from the pre-planarizing thickness measurement.

The actual thickness change $\Delta T_{actual}$ may be used to calculate the material removal factor R in process 380. This material removal factor R may comprise a ratio of the actual thickness change $\Delta T_{actual}$ to the planarizing time $t_{in}$ on the main planarizer 110 (or planarizers 110 and 112). For example, the material removal factor R may be calculated as a material removal rate by dividing the actual thickness change $\Delta T_{actual}$ by the planarizing time on the main planarizer 110. Alternatively, the material removal factor R may be determined as a length of time necessary to remove a given thickness by dividing the planarizing time $t_{in}$ by the actual thickness change $\Delta T_{actual}$.

In at least one embodiment of the invention, the material removal factor R is adjusted by a thickness offset $T_{offset}$ corresponding to the amount of material removed from the workpiece in the second planarizing process 350. In particular, the actual thickness change $\Delta T_{actual}$ may be reduced by the thickness offset $T_{offset}$ to provide an adjusted thickness change $\Delta T_{adjusted}$ before calculating the material removal factor R as a ratio of the adjusted thickness change $\Delta T_{adjusted}$ and the planarizing time $t_{in}$. For example, if the material removal factor $R_{main}$ is an approximation of a material removal rate for the main planarizing stage, it may be calculated as follows:

$$R_{main}=(\Delta T_{actual}-T_{offset})/t_{in}$$

The value of the thickness offset $T_{offset}$ to compensate for material removed by the finishing planarizer may be determined empirically or in any other suitable fashion. In one embodiment, the thickness offset $T_{offset}$ may remain constant over a significant period of time, e.g., over a plurality of planarizing cycles. For example, the thickness offset $T_{offset}$ may be determined empirically as an average thickness removed from a number of like microfeature workpieces 12 by the second planarizing process 350. In other embodiments, the thickness offset $T_{offset}$ may vary over time. For example, the thickness offset $T_{offset}$ may be determined as a function of anticipated change in the material removal rate in the second planarizing process 350. This anticipated change also may be determined empirically and may be used to compensate for estimated changes in the material removal rate in the second planarizing process 350, e.g., as the planarizing medium of the finishing planarizer 210 or second finishing planarizer 212 (FIG. 2A) changes with use.

The workpiece counter n may be indexed by one in process 390 and processes 310-390 may be performed on the next microfeature workpiece 12. This series of processes may be repeated until all of the microfeature workpieces 12 in the batch of workpieces have been planarized.

The target planarizing time $t_{in}$ for each microfeature workpiece 12 may be calculated in process 330 as a function of the material removal rate R determined in process 380 for at least one preceding microfeature workpiece 12. In one embodiment, the material removal factor R is calculated in process 380 as an average of the material removal factor for two or more sequential workpieces 12, e.g., using an exponential weighted moving average.

Embodiments of the invention provide material improvements in the precision with which the planarizing time for a given microfeature workpiece 12 may be estimated. As noted above, the precision of this estimate decreases significantly using conventional techniques when the thickness of the material to be removed is relatively thin, e.g., less than 1,000 Å. Embodiments of the present invention, however, more effectively isolate the effects of the finishing planarizer 210 (and second finishing planarizer 212, if employed) on the estimated polishing time for main planarizers 110 and 112 by factoring in the thickness offset $T_{offset}$ associated with the second planarizing process 350.

To illustrate advantages of embodiments of the invention, consider an idealized example in which a first microfeature workpiece 12 is planarized on the main planarizers 110 and 112 for a total of 10 seconds. The actual thickness change $\Delta T_{actual}$ is determined to be about 600 Å.

Scenario 1 (employing conventional control processes): In a conventional control algorithm, the material removal rate would be calculated as the actual thickness change divided by the planarizing time, i.e., 600 Å/10 sec=60 Å/sec. Assume a second microfeature workpiece 12 is determined to require removal of 900 Å. Dividing 900 Å by the calculated removal rate of 60 Å/sec estimates a target planarizing time of 15 seconds. After planarizing the second microfeature workpiece on the planarizers 110, 112, and 210, the actual thickness change $\Delta T_{actual}$ is determined to be only about 750 Å, leaving the second microfeature workpiece 12 significantly underplanarized. The removal rate for the second microfeature workpiece 12 would be calculated as 50 Å/sec (750 Å/15 sec). The planarizing time for next microfeature workpiece 12 may be estimated using either this 50 Å/sec rate or an average removal rate for the first and second microfeature workpieces 12, e.g., 55 Å/sec.

Scenario 2 (employing an embodiment of the invention): Assume that the second planarizing process 350 (including ramp-up and ramp-down processes on the main planarizer 110 and planarizing on the finishing planarizer 210) was monitored over time and found to remove about 300 Å on average. Using this 300 Å average as the thickness offset $T_{offset}$ the adjusted thickness change $\Delta T_{adjusted}$ for the first microfeature workpiece 12 can be calculated as 600 Å−300 Å=300 Å. Dividing the adjusted thickness change $\Delta T_{adjusted}$ by the 10-second planarizing time yields a material removal rate R of 30 Å/sec. In accordance with an embodiment of the invention, the thickness offset $T_{offset}$ may be subtracted from the target thickness change $\Delta T_{in}$ of 900 Å for the second microfeature workpiece to yield a reduced target thickness change $\Delta T_{seduced}$ of 900 Å−300 Å=600 Å. Dividing this reduced target thickness change $\Delta T_{reduced}$ by the material removal rate R yields a target planarizing time $t_{in}$ of 20 seconds. The actual thickness change $\Delta T_{actual}$ of the second microfeature workpiece 12 after completing the planarizing cycle on the three planarizers 110, 112 and 210 is assumed to be 890 Å, a nominal deviation from the 900 Å target thickness change $\Delta T_{in}$. Dividing adjusted thickness change $\Delta T_{adjusted}$ for the second microfeature workpiece 12 (890 Å−300 Å=590 Å) by the 20-second combined planarizing time $t_{in}$ on the main planarizers yields a material removal rate R of 29.5 Å/sec.

Comparing these two scenarios, the planarizing time necessary to remove the desired thickness of material from the second microfeature workpiece 12 is estimated significantly more accurately in Scenario 2 employing an embodiment of the invention than in the more conventional Scenario 1. Whereas the second planarized microfeature workpiece 12 in Scenario 2 likely would fall within commercially acceptable tolerances, the second planarized workpiece in Scenario 1 likely would be rejected if planarizing relied solely on the estimated planarizing time. Scenario 2 is also more precise than Scenario 1 in calculating the pertinent material removal rate, with the anticipated standard deviation in Scenario 2 being substantially less than the standard deviation in Scenario 1.

The preceding discussion focuses on planarizing microfeature workpieces 12, but aspects of the present invention may also be useful in other contexts. For instance, a method analogous to method 300 of FIG. 4 may be used to control a deposition process wherein microfeature workpieces are subjected to two deposition processes with different rates of material deposition. In a microfeature workpiece deposition process employing both chemical vapor deposition (CVD) and atomic layer deposition (ALD), for example, one or more parameters of the CVD process may be controlled on the basis of a deposition rate calculated using a thickness offset $T_{offset}$ correlated to the amount of material deposited via ALD.

In general, the terms used in the following claims should not be construed to limit the invention to the specific embodiments disclosed in the specification unless the above-detailed description explicitly defines such terms. While certain aspects of the invention are presented below in certain claim forms, the inventors contemplate various aspects of the invention in any number of claim forms. Accordingly, the inventors reserve the right to add additional claims after filing the application to pursue such additional claim forms for other aspects of the invention.

We claim:

1. A method for processing microfeature workpieces, comprising:

subjecting a first microfeature workpiece to a first process for a first process time, the first process changing a thickness of the first microfeature workpiece at a first rate;

subjecting the first microfeature workpiece to a second process, the second process changing the thickness of the first microfeature workpiece at a second rate that differs from the first rate;

determining a thickness change of the first microfeature workpiece attributable to both the first process and the second process;

calculating an offset thickness change by offsetting the thickness change by a thickness offset associated with the second process;

determining a thickness change factor for the first microfeature workpiece as a ratio of the offset thickness change and the first processing time;

determining a target thickness change for a second microfeature workpiece by comparing a second pre-processing thickness of the second microfeature workpiece with a target thickness of the second microfeature workpiece;

determining a target processing time as a function of the target thickness change and the thickness change factor;

subjecting the second microfeature workpiece to the first process for the target processing time; and subjecting the second microfeature workpiece to the second process.

2. The method of claim 1 wherein the first process and the second process each comprise a planarizing process in which material is removed from a surface of a microfeature workpiece.

3. The method of claim 1 wherein the first process and the second process each comprise a deposition process in which material is deposited on a surface of a microfeature workpiece.

4. The method of claim 3 wherein the first microfeature workpiece is subjected to the second process after it is subjected to the first process.

5. The method of claim 1 wherein the first microfeature workpiece is subjected to a first segment of the second process before it is subjected to the first process and is subjected to a second segment of the second process after it is subjected to the first process.

6. The method of claim 1 wherein determining the thickness change factor comprises dividing the offset thickness change by the first processing time.

7. The method of claim 1 wherein determining the thickness change factor comprises dividing the offset thickness change by the first processing time and determining the target processing time comprises dividing the target thickness change by the thickness change factor.

8. The method of claim 1 wherein determining the target processing time comprises:

determining an adjusted target by reducing the target thickness change by the thickness offset; and dividing the adjusted target by the thickness change factor.

9. The method of claim 1 wherein the thickness offset is a constant value for a plurality of microfeature workpieces.

10. The method of claim 1 wherein the thickness offset is a constant value determined as an average thickness change for the second process.

11. The method of claim 1 wherein the thickness offset varies over time.

12. The method of claim 1 wherein the thickness offset varies over time as a function of anticipated change in a rate at which the second process changes the microfeature workpiece thickness.

13. The method of claim 1 wherein determining the thickness change factor further comprises averaging the thickness change factor for the first microfeature workpiece with the thickness change factor determined for at least one previously-processed microfeature workpiece.

14. The method of claim 1 wherein the second process changes the thickness of the first microfeature workpiece at a rate that is independent of the thickness change factor.

15. The method of claim 1 wherein the thickness change of the first microfeature workpiece is determined by measuring a pre-processing thickness of the first microfeature workpiece before subjecting the first microfeature workpiece to the first and second processes; measuring a post-processing thickness of the first microfeature workpiece after subjecting the first microfeature workpiece to the first and second processes; and comparing the pre-processing thickness and the post-processing thickness.

* * * * *